US009358548B2

(12) United States Patent
Barthelmess et al.

(10) Patent No.: US 9,358,548 B2
(45) Date of Patent: Jun. 7, 2016

(54) MILLING PARTICLES IN DRILLING FLUID

(71) Applicants: ECUTEC Barcelona S.L., Barcelona (ES); M-I L.L.C., Houston, TX (US)

(72) Inventors: Thomas Philip Barthelmess, Barcelona (ES); Sergio Alegre Fernandez-Caro, Barcelona (ES); Philip David Burton, Katy, TX (US); Gary Woolsey, Katy, TX (US)

(73) Assignees: Ecutec Barcelona, S.L., Barcelona (ES); M-I L.L.C., Houston, TX (US)

( * ) Notice: Subject to any disclaimer, the term of this patent is extended or adjusted under 35 U.S.C. 154(b) by 174 days.

(21) Appl. No.: 13/752,209

(22) Filed: Jan. 28, 2013

(65) Prior Publication Data

US 2014/0209717 A1 Jul. 31, 2014

(51) Int. Cl.

| | |
|---|---|
| ***B02C 13/06*** | (2006.01) |
| ***B02C 21/00*** | (2006.01) |
| ***B02C 13/282*** | (2006.01) |
| ***B02C 13/284*** | (2006.01) |
| ***B02C 13/30*** | (2006.01) |
| ***B02C 17/16*** | (2006.01) |
| ***B02C 17/18*** | (2006.01) |
| ***B02C 17/24*** | (2006.01) |
| ***E21B 21/06*** | (2006.01) |

(52) U.S. Cl.

CPC ..... *B02C 21/00* (2013.01); *B02C 13/06* (2013.01); *B02C 13/282* (2013.01); *B02C 13/284* (2013.01); *B02C 13/30* (2013.01); *B02C 17/16* (2013.01); *B02C 17/1855* (2013.01); *B02C 17/24* (2013.01); *E21B 21/066* (2013.01)

(58) Field of Classification Search

CPC .... B02C 17/22; B02C 17/163; B02C 17/161; B02C 13/282; B02C 13/284; B02C 21/00; B02C 23/10; B02C 17/24; B02C 13/30; B02C 17/16; B02C 17/1855; B02C 13/06; E21B 21/066

USPC ..... 241/152.2

See application file for complete search history.

(56) References Cited

U.S. PATENT DOCUMENTS

| | | | | | |
|---|---|---|---|---|---|
| 2,260,826 | A | * | 10/1941 | Booge | 106/449 |
| 3,910,507 | A | * | 10/1975 | Okada et al. | 241/73 |
| 5,375,779 | A | | 12/1994 | Ephraim | |
| 5,551,639 | A | * | 9/1996 | Artemjev et al. | 241/5 |
| 5,655,720 | A | * | 8/1997 | Hixon et al. | 241/189.1 |
| 6,453,584 | B1 | | 9/2002 | Buckner | |
| 7,374,115 | B2 | * | 5/2008 | Geiger et al. | 241/171 |
| 2002/0033278 | A1 | | 3/2002 | Reddoch | |
| 2008/0099591 | A1 | | 5/2008 | Cerra et al. | |
| 2012/0234952 | A1 | | 9/2012 | Nordell | |

OTHER PUBLICATIONS

International Search Report and Written Opinion for corresponding PCT Application No. PCT/US2014/012423 dated Apr. 29, 2014, 14 pages.

* cited by examiner

*Primary Examiner* — Mark Rosenbaum

(57) ABSTRACT

This disclosure is drawn to systems, devices, apparatuses, and/or methods, related to milling particles in drilling fluid. Specifically, the disclosed systems, devices, apparatuses, and/or methods relate to milling particles in drilling fluid using multiple milling techniques. Some example apparatuses may include a first mill to grind particles from the original diameter to a first reduced diameter, and a second mill to grind the particles from the first reduced diameter to a second reduced diameter, where the second reduced diameter is less than the first reduced diameter.

14 Claims, 10 Drawing Sheets

MILLING PARTICLES IN DRILLING FLUID

BACKGROUND

In oilfield environments, treatment of particles (e.g., cuttings) from drilling fluid must be reduced in size for them be able to be pumped into hydraulically induced fractures. Conventionally, the size of the particles as they come out of the drilling process is in a range of 0-30 mm. The size has to be reduced to a size below 300 microns, which is a size reduction ratio of 1:100. Such reduction is typically done with degradation centrifugal pumps or roller and hammer mills, which have either one or two shafts.

Conventional hammer mills can grind particles down to a certain particle size, but then get inefficient the finer the particles are. This leads to a build-up of particles in the milling circuit, which leads to high abrasion on the milling tools, high energy consumption, and equipment failure.

BRIEF DESCRIPTION OF THE DRAWINGS

The foregoing and other features of the present disclosure will become more fully apparent from the following description and appended claims, taken in conjunction with the accompanying drawings. Understanding that these drawings depict several embodiments in accordance with the disclosure and are, therefore, not to be considered limiting of its scope, the disclosure will be described with additional specificity and detail through use of the accompanying drawings.

In the drawings.

DETAILED DESCRIPTION

Figure 1:
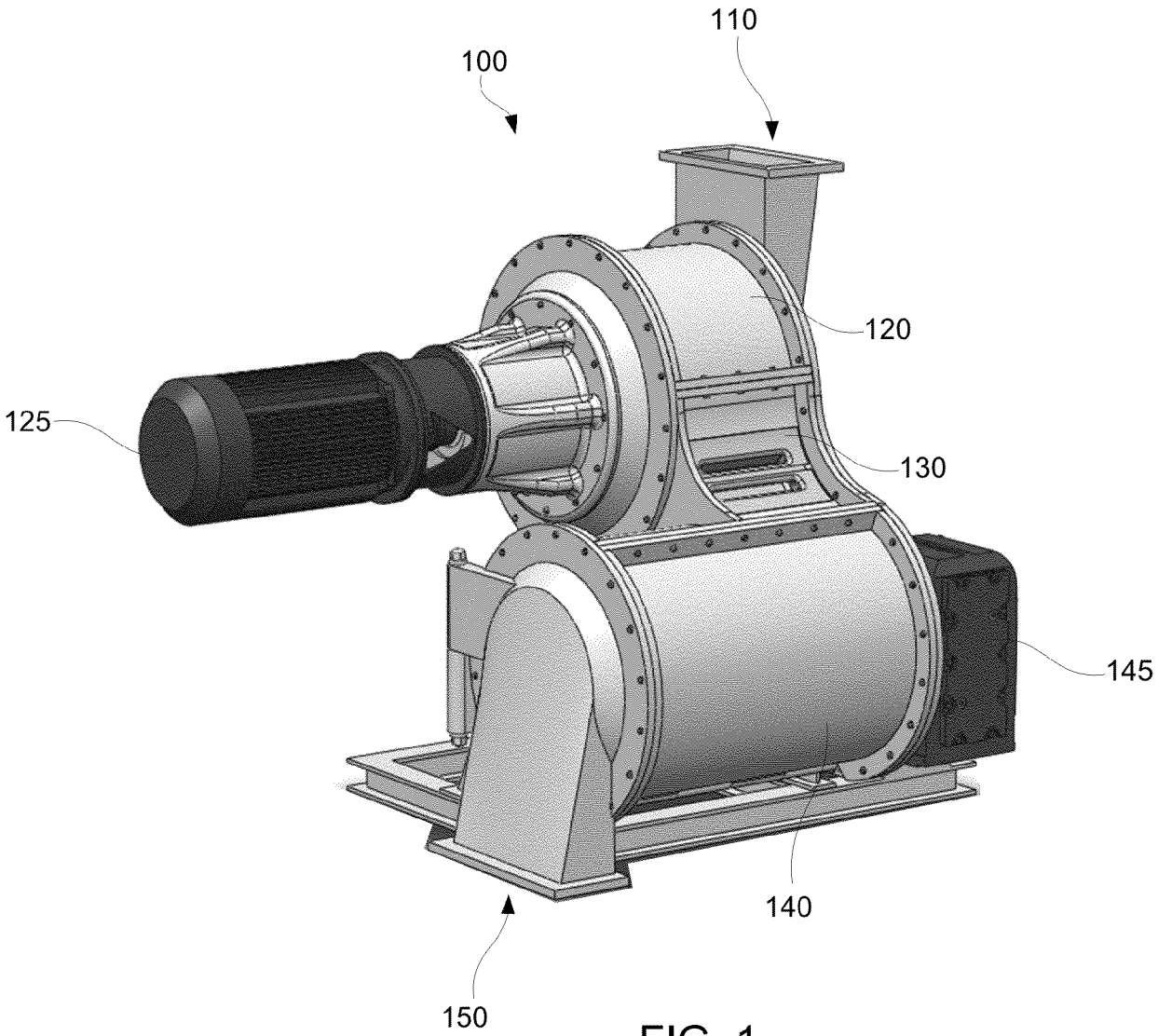
FIG. 1 is a perspective view of an example milling system.

In the following detailed description, reference is made to the accompanying drawings, which form a part hereof. In the drawings, similar symbols identify similar components, unless context dictates otherwise. The illustrative embodiments described in the detailed description and drawings are not meant to be limiting and are for explanatory purposes. Other embodiments may be utilized, and other changes may be made, without departing from the spirit or scope of the subject matter presented herein. It will be readily understood that the aspects of the present disclosure, as generally described herein, and illustrated in the drawings, may be arranged, substituted, combined, and designed in a wide variety of different configurations, each of which are explicitly contemplated and made part of this disclosure.

This disclosure is drawn to systems, devices, apparatuses, and/or methods, related to milling particles in drilling fluid. Specifically, the disclosed systems, devices, apparatuses, and/or methods relate to milling particles in drilling fluid using multiple milling techniques.

FIG. 1 depicts an example system 100 that may be used to mill particles in a drilling fluid, in accordance with at least an embodiment of the present disclosure. Example system 100 may include a first mill 120 adapted to grind the particles to reduce their diameter. Example system 100 may also include a second mill 140 to grind the particles to further reduce their diameter.

Example system 100 may receive drilling fluid including particles from an inlet 110. Inlet 110 may direct the drilling fluid including particles into first mill 120. A first motor 125 may be coupled to first mill 120 such that first motor 125 drives first mill 120. As first motor 125 causes first mill 120 to operate, first mill 120 may grind the particles. As first mill 120 grinds the particles, the particles' diameter is reduced, and at least some of the particles may be transferred to second mill 140. When the diameter of the particles in first mill 120 is smaller than gaps in diaphragm 130, the particles may exit first mill 120 to second mill 140 via diaphragm 130.

Second motor 145 may be coupled to second mill 140 such that second motor 145 drives second mill 140. As second motor 145 causes second mill 140 to operate, second mill 140 may grind particles. As second mill 140 grinds the particles, the particles' diameter is further reduced, and at least some of the particles may be transferred to an outlet 140 through an outlet diaphragm. When the diameter of the particles in second mill 140 is smaller than gaps in the outlet diaphragm, the particles may exit second mill 140 to outlet 150.

Operation of example system 100 may be controlled by an operator via a control panel. Some example control panels may receive input to control operation of the first mill and/or the second mill. Additionally, some example control panels may include error conditions and/or monitoring services to notify an operator of system statuses.

In some examples, first mill 120 may be a hammer mill and second mill 140 may be a pearl mill. In some examples, the hammer mill may be horizontally oriented. In some examples, the pearl mill may be horizontally oriented. In some examples, first motor 125 and second motor 145 may be any type of motor, including a direct drive engine or a gear drive engine.

Figure 2:
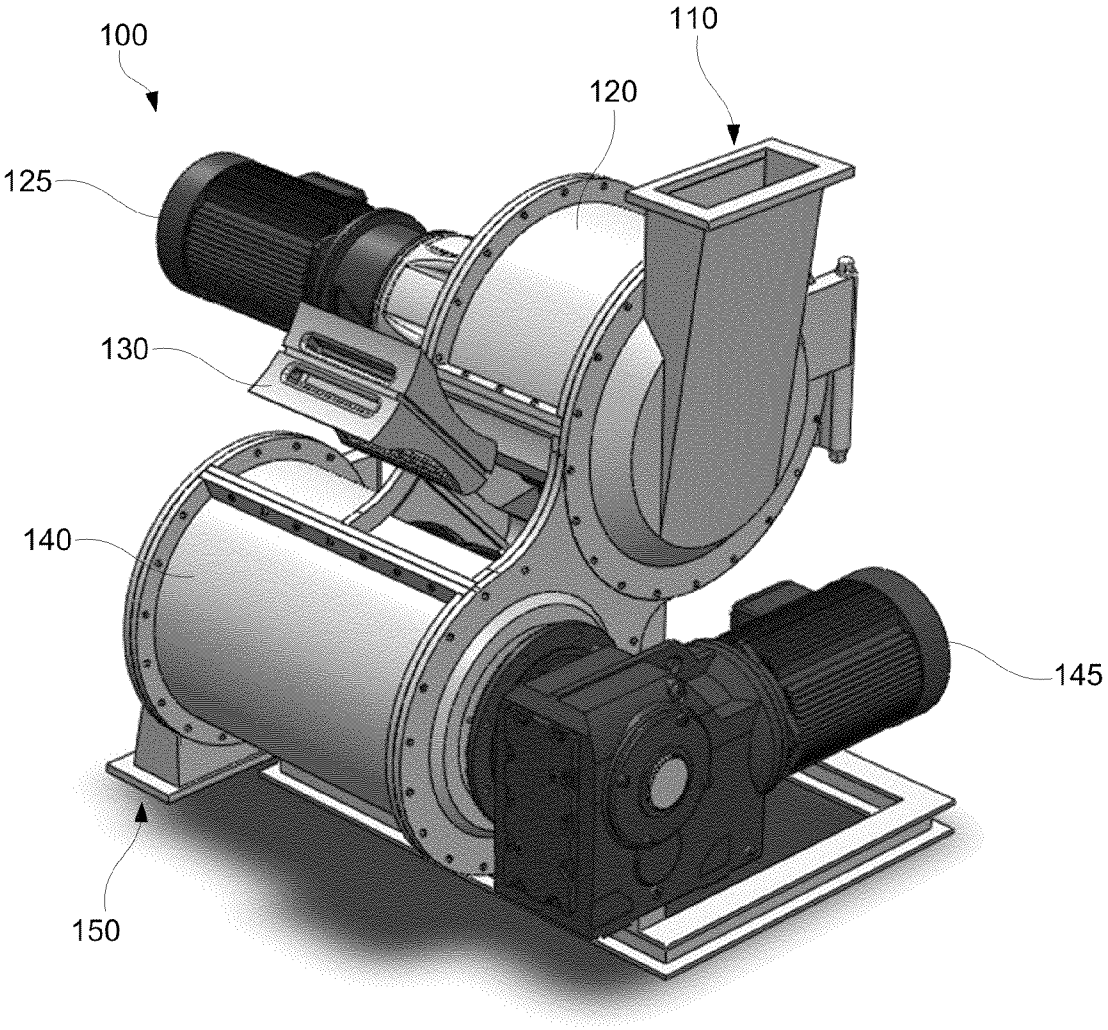
FIG. 2 is another perspective view of the example milling system of FIG. 1.

FIG. 2 depicts another view of example system 100. For illustrative purposes, diaphragm 130 is depicted as being removed from the apparatus of example system 100.

Figure 3:
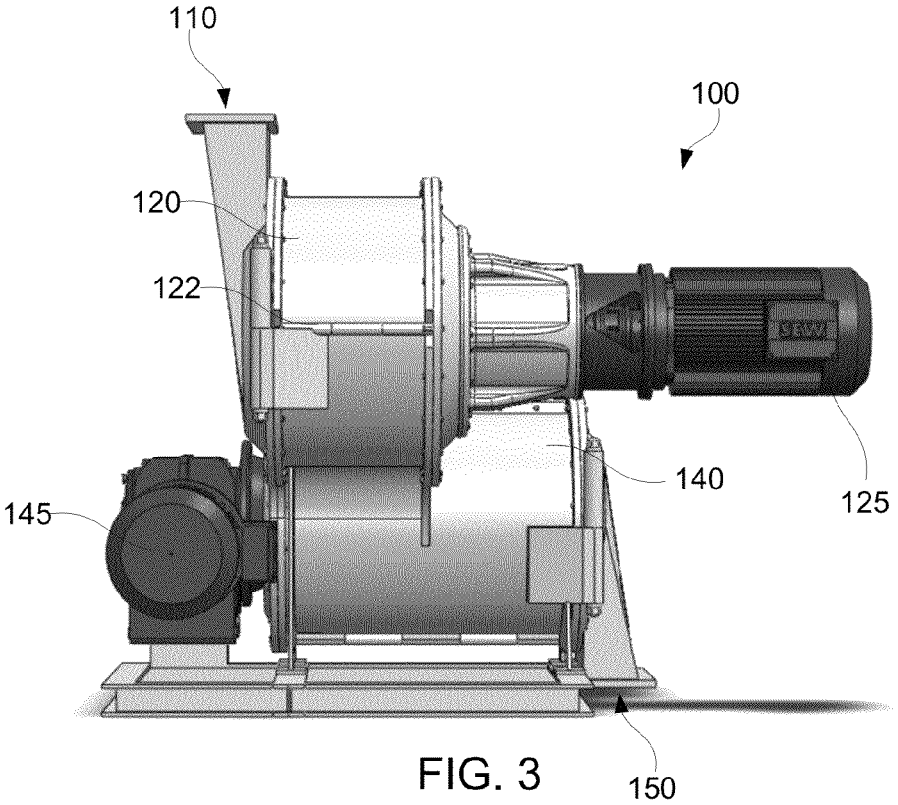
FIG. 3 is a rear view of the example milling system of FIG. 1.

FIG. 3 depicts a rear view of example system 100. First mill 120 may include a hinged portion that allows an operator to open the top of first mill 120. This hinged portion may include a hinge 122 coupled to a rear portion of first mill 120.

Figure 4:
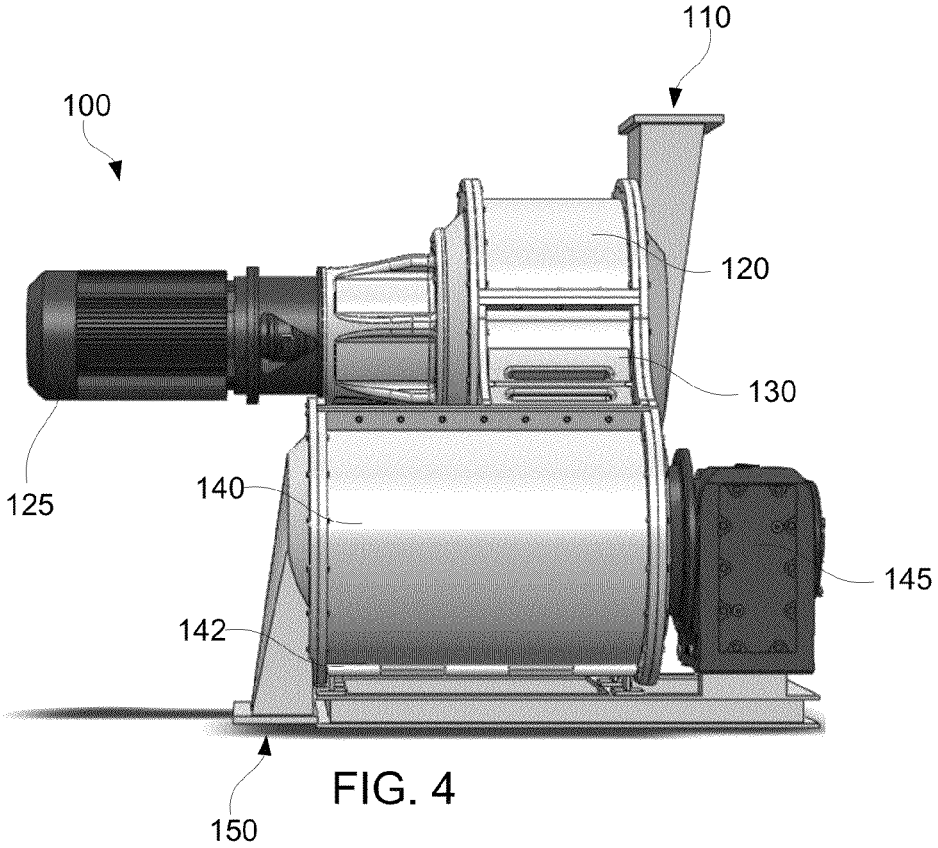
FIG. 4 is a front view of the example milling system of FIG. 1.

FIG. 4 depicts a front view of example system 100. Second mill 140 may include a hinged portion that allows an operator to open the front of second mill 140. This hinged portion may include a hinge 142 coupled to a lower portion of second mill 140.

Figure 5:
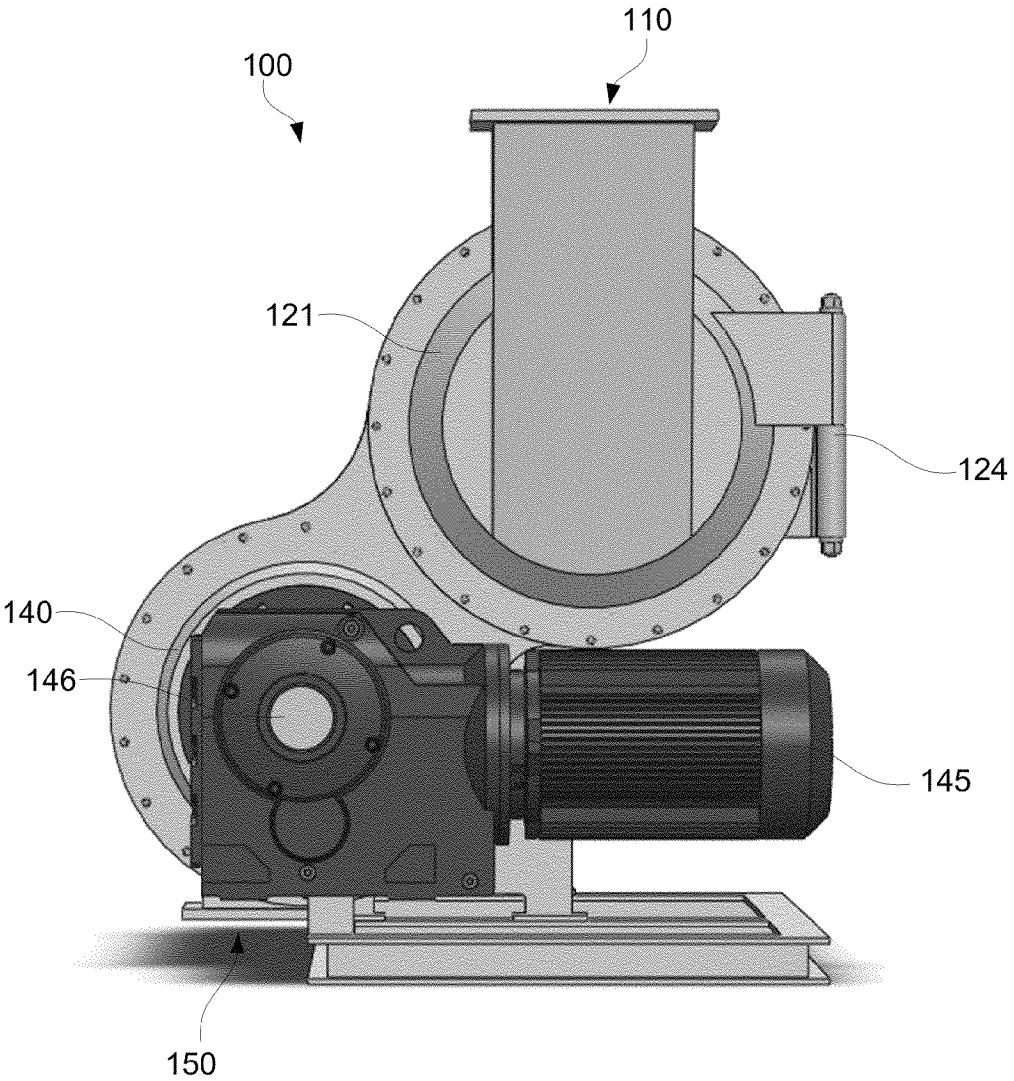
FIG. 5 is a side view of the example milling system of FIG. 1.

FIG. 5 depicts a side view of example system 100. First mill 120 may include an access door 121 portion that allows an operator to open the side of first mill 120. Access door 121 may include a hinge 124 coupled to a portion of first mill 120. Also shown in FIG. 5, second motor 145 may drive a shaft 146 used in operating second mill 140.

Figure 6:
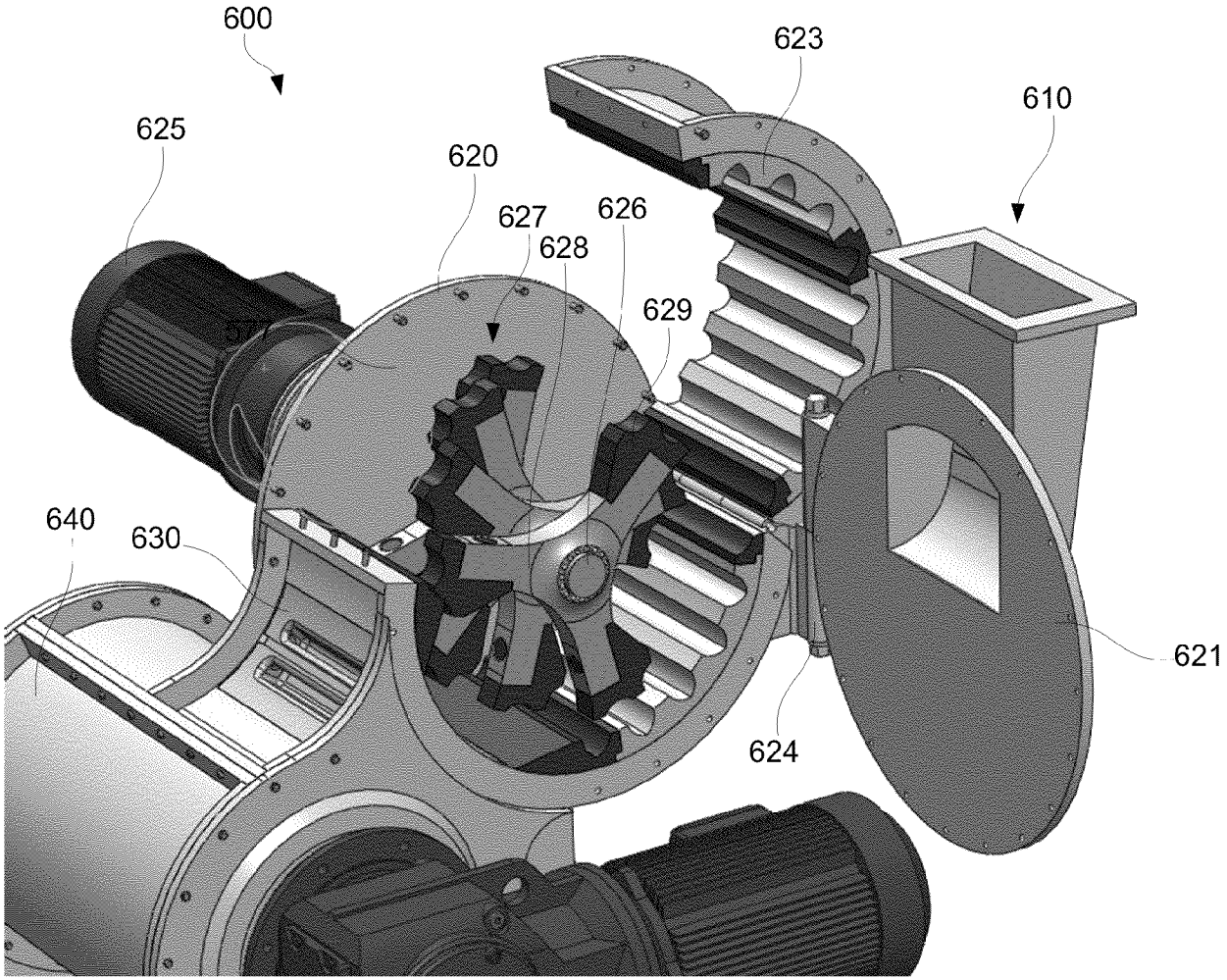
FIG. 6 is a perspective view of an example hammer mill of an example milling system.

FIG. 6 depicts a portion of an example system 600 that may be used to mill particles in a drilling fluid, in accordance with at least an embodiment of the present disclosure. Specifically, FIG. 6 primarily shows an example hammer mill 620 adapted to grind particles to reduce their diameter. Example system 600 may also include a pearl mill 640 to grind the particles to further reduce their diameter.

Hammer mill 620 may include an access door 621 portion that allows an operator to open the side of hammer mill 620. Access door 621 may include a hinge 624 coupled to a portion of hammer mill 620. FIG. 6 depicts access door 621 in an open position.

Hammer mill 620 may include a hinged portion that allows an operator to open the top of hammer mill 620. This hinged portion may include a hinge coupled to a rear portion of hammer mill 620. FIG. 6 depicts hinged portion in an open position.

Hammer mill 620 may be a rotary mill that grinds particles using impact force(s). Hammer mill 620 may be coupled to a motor 625 such that motor 625 causes hammer mill 620 to operate. Specifically, motor 625 may be coupled to and rotate a shaft 626 within hammer mill 620. Impact tool(s) 627 may be removably coupled to shaft 626. FIG. 6 depicts several impact tools 627 configured in a staggered or stepped configuration. Other configurations may also be used. In some examples, each impact tool 627 may be independently coupled to shaft 626 and may be separately removable and/or replaceable.

In some examples, each impact tool 627 may include a rotor 628. In some examples, a tool head 629 may be removably coupled to each rotor 628. Tool head 629 may be independently coupled to rotor 628 and may be separately removable and/or replaceable. In some examples, rotor 628 may include multiple arms extending away from shaft 626. In some examples, a tool head 629 may be removably coupled to the end of each arm.

In some examples, impact tools 627 and/or tool heads 629 may be of tungsten carbide or other suitable material.

In some examples, hammer mill 620 may include liner(s) 623 coupled to the interior of hammer mill 620. In some examples, liner(s) 623 may be removable from hammer mill 620 in multiple pieces or as a single component.

Example system 600 may receive drilling fluid including particles from an inlet 610. Inlet 610 may direct the drilling fluid including particles into hammer mill 620. Motor 625 causes hammer mill 620 to operate to grind the particles. As hammer mill 620 grinds the particles, the particles' diameter is reduced, and at least some of the particles may be transferred to pearl mill 640. When the diameter of the particles in hammer mill 620 is smaller than gaps in diaphragm 630, the particles may exit hammer mill 620 to pearl mill 640 via diaphragm 630.

Figure 7:
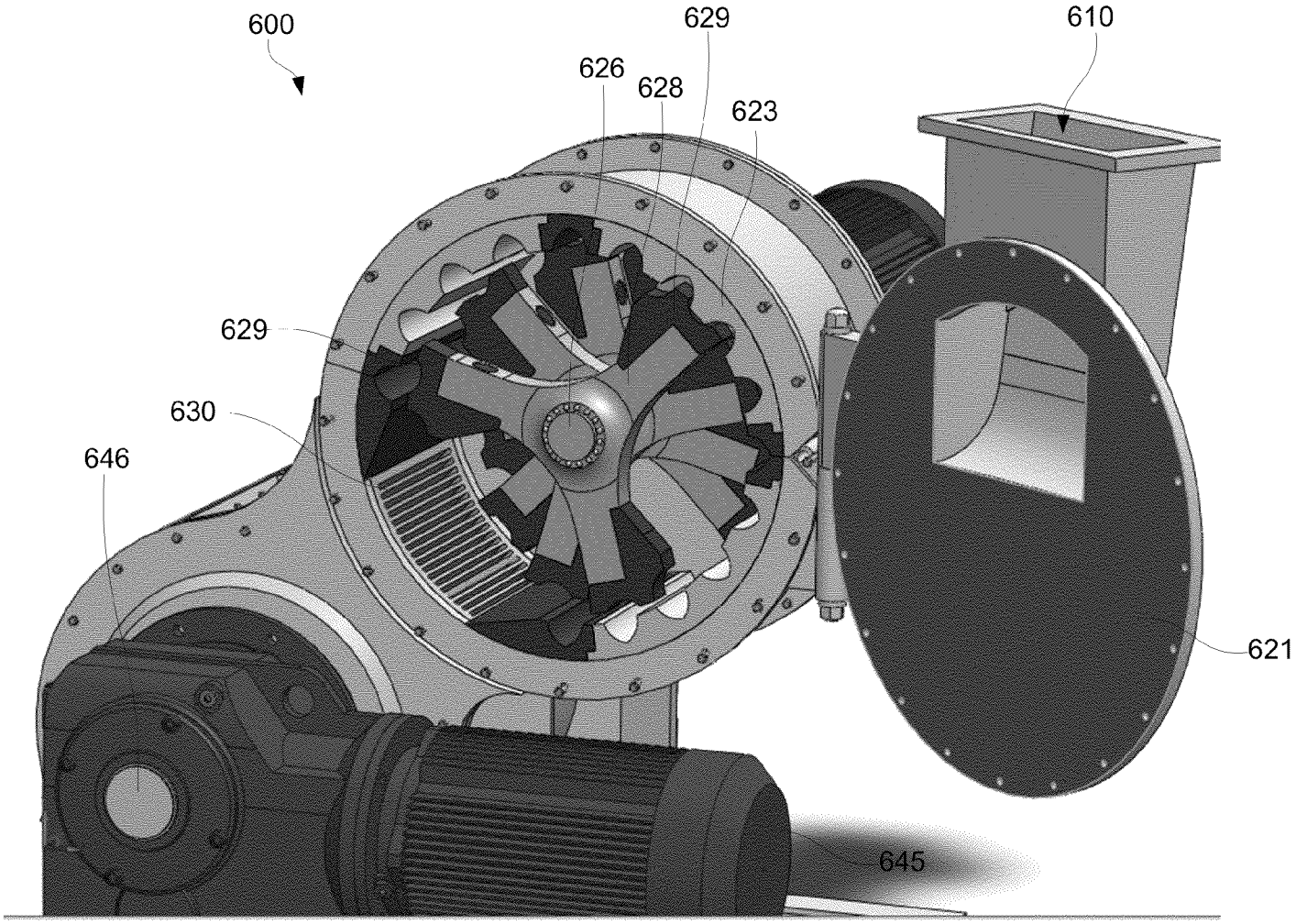
FIG. 7 is another perspective view of the example hammer mill of the example milling system of FIG. 6.

FIG. 7 depicts another view of example system 600. Specifically, FIG. 7 again primarily shows hammer mill 620. Access door 621 is in the open position and the hinged portion is in a closed position. Similar to FIG. 6, hammer mill 620 is lined with liner(s) 623, and includes shaft 626 coupled to impact tool(s) 627. Impact tools 627 include rotor(s) 628, each coupled to tool head(s) 629.

FIG. 7 also shows diaphragm 630. Diaphragm 630 may include gaps that allow particles through to the pearl mill 640 provided the particles have a diameter smaller than the gaps. Diaphragm 630 may be removable and replaceable, and different diaphragms may have gaps of different sizes. In some examples, diaphragm 630 may be cleaned using a diaphragm cleaning system within the first mill. Some example diaphragm cleaning systems may spray the diaphragm with a cleaning fluid (e.g., water, cleaning solution).

Figure 8:
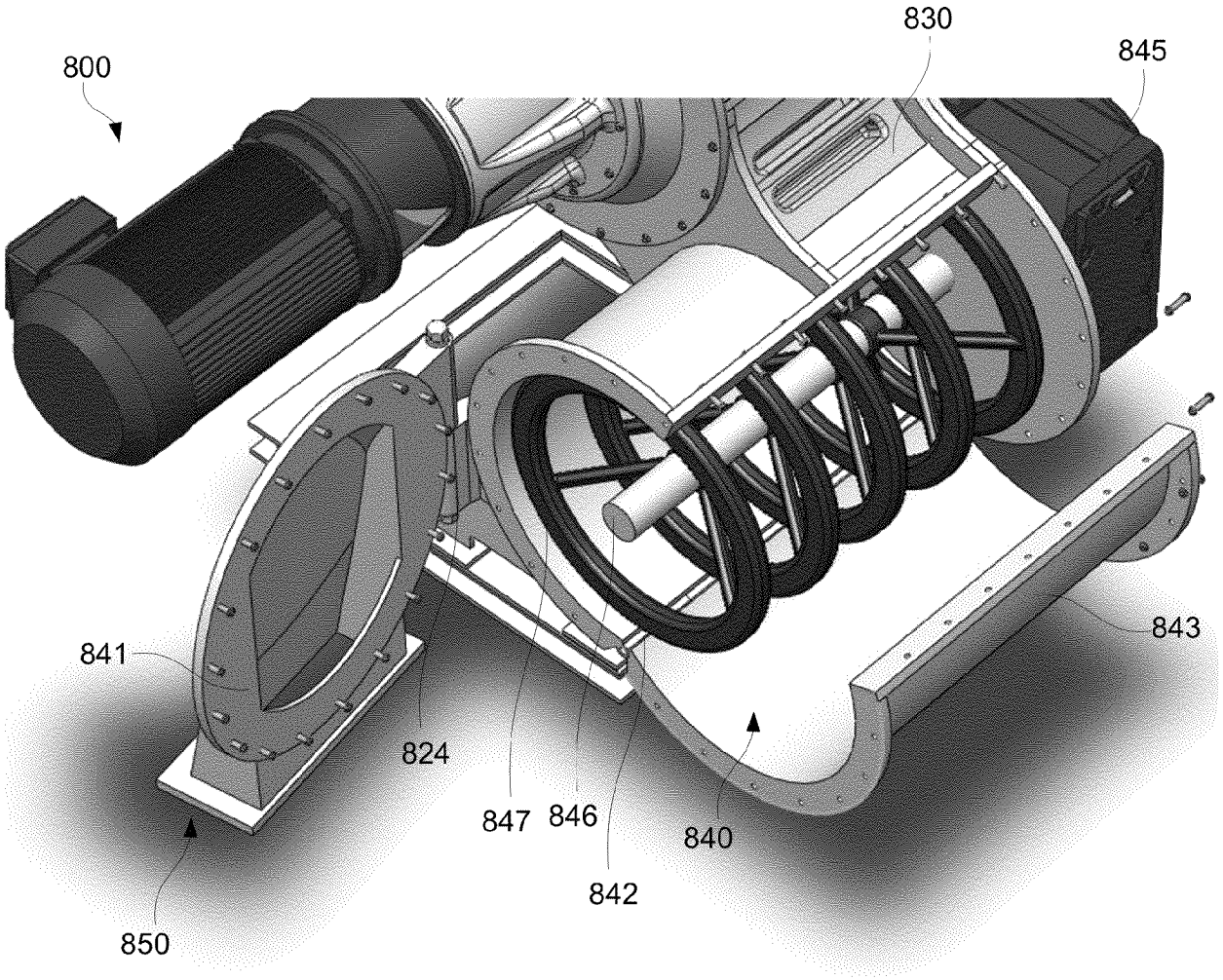
FIG. 8 is a perspective view of an example pearl mill of an example milling system.

FIG. 8 depicts a portion of an example system 800 that may be used to mill particles in a drilling fluid, in accordance with at least an embodiment of the present disclosure. Specifically, FIG. 8 primarily shows an example pearl mill 840 adapted to grind particles to further reduce their diameter.

Pearl mill 840 may include an access door 841 portion that allows an operator to open the side of pearl mill 840. Access door 841 may include a hinge 824 coupled to a portion of pearl mill 840. FIG. 8 depicts access door 821 in an open position.

Pearl mill 840 may include a hinged portion 843 that allows an operator to open the front of pearl mill 840. Hinged portion 843 may include a hinge 842 coupled to a lower portion of pearl mill 840. FIG. 6 depicts hinged portion 843 in an open position.

Pearl mill 840 may be a rotary mill that grinds particles primarily using friction. Pearl mill 840 may be coupled to a motor 845 such that motor 845 causes pearl mill 840 to operate. Specifically, motor 845 may be coupled to and rotate a shaft 846 within pearl mill 840. Rotation tool(s) 847 may be removably coupled to shaft 846. FIG. 8 depicts several rotation tools 847 configured serially. Other configurations may also be used. In some examples, each rotation tool 847 may be independently coupled to shaft 846 and may be separately removable and/or replaceable.

In some examples, pearl mill 840 may include liner(s) coupled to the interior of pearl mill 840. In some examples, liner(s) may be removable from pearl mill 840 in multiple pieces or as a single component.

Pearl mill 840 may receive the drilling fluid including particles from hammer mill via diaphragm 830. Motor 845 causes pearl mill 840 to operate to grind the particles. As pearl mill 840 rotates, the particles may contact grinding media, the rotation tool(s), and/or liner(s). Such contact acts to grind the particles, and the particles' diameter is reduced (even further than in the hammer mill). In some examples, grinding media may include ceramic grinding media or other suitable grinding material. At least some of the particles may be transferred through outlet diaphragm to outlet 850. When the diameter of the particles in pearl mill 840 is smaller than gaps in outlet diaphragm, the particles may exit pearl mill 840 to outlet 850 via outlet diaphragm.

Figure 9:
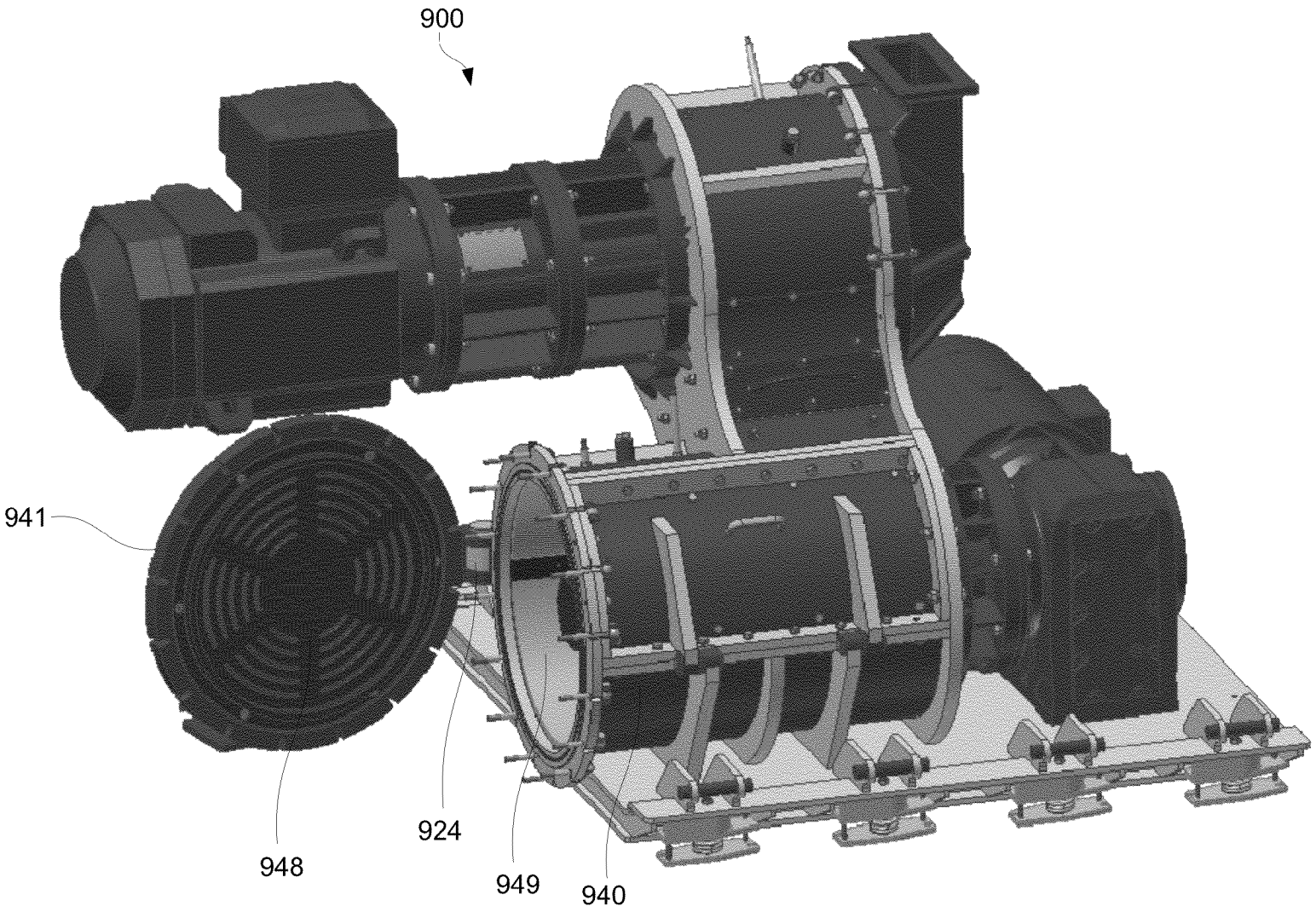
FIG. 9 is a perspective view of another example pearl mill of an example milling system.

FIG. 9 depicts a perspective view of another example pearl mill of an example milling system, in accordance with at least an embodiment of the present disclosure. FIG. 9, among other items, includes a pearl mill 940 having an open access door 941. Access door 941 may include a hinge 924 coupled to a portion of pearl mill 940. An example outlet diaphragm 948 may be removably or permanently coupled to access door 941. A liner 949 may be removably or permanently coupled to an interior surface of pearl mill 940.

Figure 10:
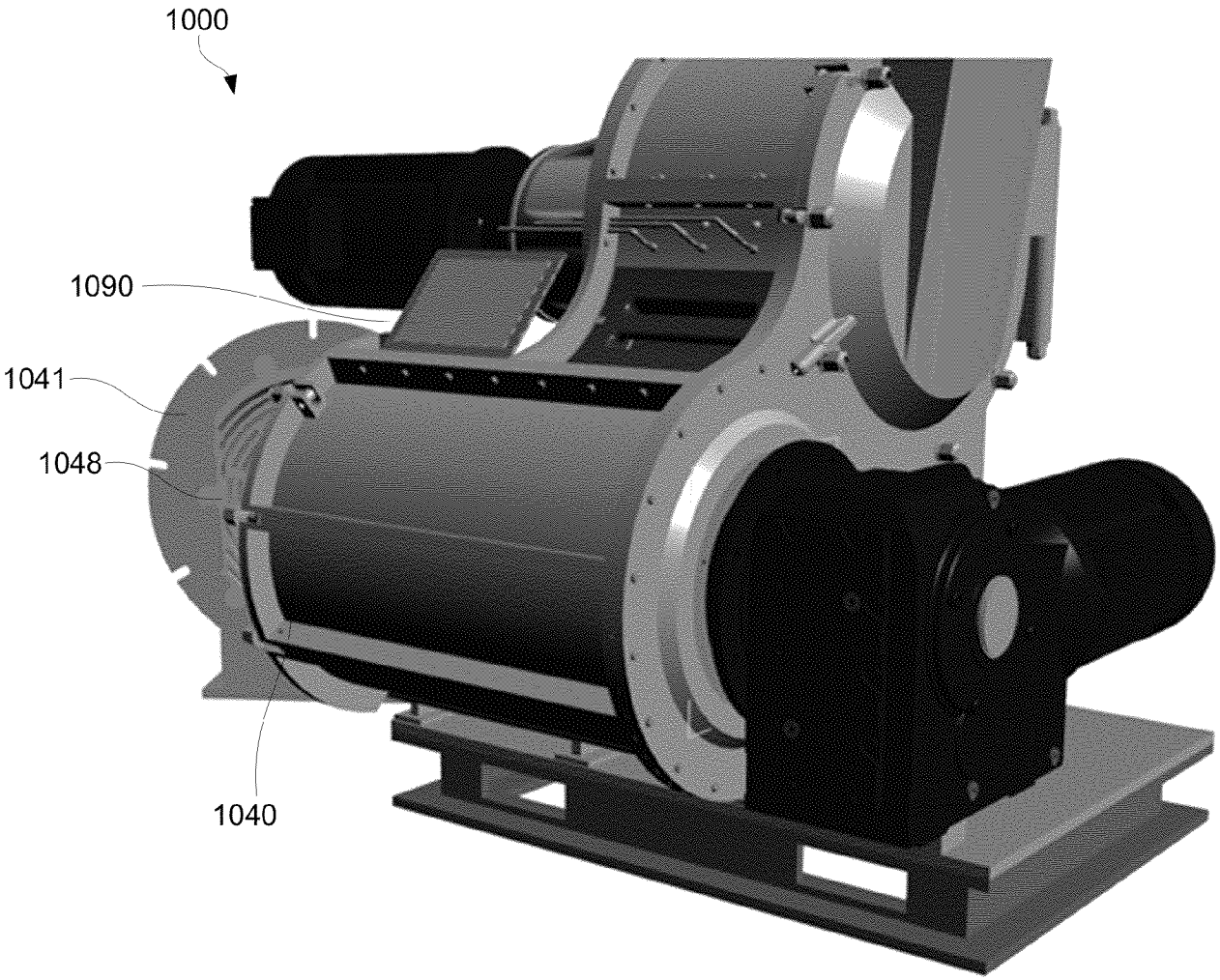
FIG. 10 is a perspective view of another example milling system.

FIG. 10 depicts a perspective view of another example milling system, in accordance with at least an embodiment of the present disclosure. FIG. 10, among other items, includes a pearl mill 1040 having an open access door 1041 and an outlet diaphragm 1048. Operation of example system 1000 may be controlled by an operator via a control panel 1090. Control panel 1090 may receive input to control operation of the hammer mill and/or pearl mill 1040. Additionally, control panel 1090 may display error conditions and/or monitoring services to notify an operator of system statuses of the hammer mill and/or pearl mill 1040.

Figure 11:
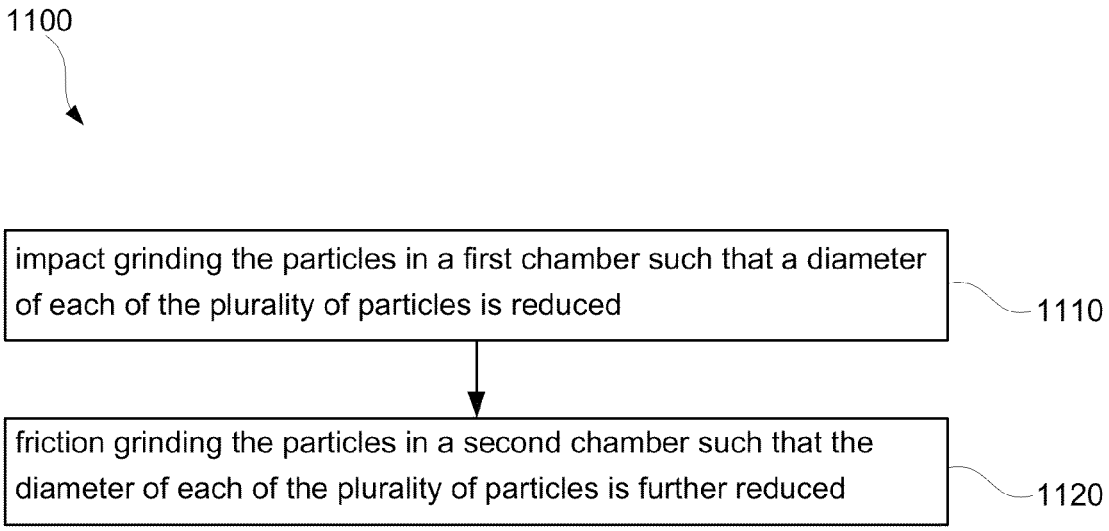
FIG. 11 is an example method of milling particles in a drilling fluid, each arranged in accordance with at least an embodiment of the present disclosure.

FIG. 11 is a flowchart depicting an example method 1100 of milling particles in a drilling fluid, in accordance with at least an embodiment of the present disclosure. Example method 1100 may include impact grinding 1110 particles in a first chamber such that a diameter of each of the plurality of particles is reduced. Example method 1100 may further include friction grinding 1120 the particles in a second chamber such that the diameter of each of the plurality of particles is further reduced.

In some examples, example method 1100 may also include, prior to friction grinding, transferring only the particles having a reduced diameter from the first chamber to the second chamber. In some examples, example method 1100 may also include, after friction grinding, transferring only the particles having a further reduced diameter from the second chamber to an outlet. In some examples, transferring particles from a first mill to a second mill may occur based on fluid pressure of the drilling fluid in the first mill.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An apparatus for milling particles having an original diameter, the apparatus comprising:

a first mill adapted to receive a drilling fluid comprising a mixture of fluid and particles and to grind the particles from the original diameter to a first reduced diameter wherein the first mill comprises a hammer mill;

a second mill adapted to receive the drilling fluid from the first mill and further adapted to grind the particles from the first reduced diameter to a second reduced diameter, wherein the second reduced diameter is less than the first reduced diameter and wherein the second mill comprises a pearl mill; and a diaphragm positioned between the first mill and the second mill, the diaphragm having a plurality of gaps configured to maintain a fluid pressure within the first mill and to allow the particles having the first reduced diameter to move from the first mill to the second mill.

2. The apparatus of claim 1, further comprising:

a first motor coupled to the first mill, the first motor adapted to drive the first mill; and a second motor coupled to the second mill, the second motor adapted to drive the second mill.

3. The apparatus of claim 2, wherein the first motor is a direct drive engine; and wherein the second motor is a gear drive engine.

4. The apparatus of claim 1, wherein the first mill comprises:

a first cylindrical chamber for receiving the drilling fluid;

a first liner removably coupled to an interior surface of the first cylindrical chamber; and a plurality of impact tools, each of the impact tools being independently, removably coupled to a shaft within the first cylindrical chamber.

5. The apparatus of claim 4, wherein each of the plurality of impact tools comprises:

a rotor; and at least one tool head removably coupled to the rotor.

6. The apparatus of claim 1, further comprising: a diaphragm cleaning system positioned within the first mill, the diaphragm cleaning system adapted to spray the diaphragm with a cleaning fluid.

7. The apparatus of claim 1, wherein the diaphragm is removable.

8. The apparatus of claim 1, wherein the second mill comprises:

a second cylindrical chamber for receiving the drilling fluid comprising a mixture of fluid and the particles having the first reduced diameter from the first mill;

a second liner removably coupled to an interior surface of the second cylindrical chamber;

a plurality of rotation tools, each of the rotation tools being independently removably coupled to a shaft within the second cylindrical chamber; and a plurality of grinding media adapted to freely move within the second cylindrical chamber.

9. The apparatus of claim 8, further comprising:

an outlet diaphragm adapted to allow particles having the second reduced diameter to exit the second mill, while disallowing the plurality of grinding media from exiting the second mill.

10. The apparatus of claim 1, further comprising:

a control panel adapted receive input to control operation of at least one of the first mill and the second mill.

11. An apparatus for milling particles, each of the respective particles having an original diameter, the apparatus comprising:

a first mill portion adapted to receive the particles in drilling fluid;

a first liner removably coupled to an interior surface of the first mill portion;

a plurality of impact tools coupled to a shaft within the first mill portion, each of the impact tools being independently, removably coupled to the shaft within the first mill portion, the plurality of impact tools adapted to impact the particles and reduce the diameter of the particles from the original diameter to a first reduced diameter;

a second mill portion adapted to receive the particles in drilling fluid having the first reduced diameter from the first mill portion;

a diaphragm positioned between the first mill portion and the second mill portion, the diaphragm having a plurality of gaps configured to allow the particles having the first reduced diameter to move from the first mill to the second mill based on fluid pressure in the first mill;

a second liner removably coupled to an interior surface of the second mill portion;

a plurality of grinding media adapted to freely move within the second mill portion; and a plurality of rotation tools coupled to a shaft within the second mill portion, each of the rotation tools being independently, removably coupled to the shaft within the second mill portion, the plurality of rotation tools adapted to mix the plurality of grinding media and the particles having the first reduced diameter and reduce the diameter of the particles having the first reduced diameter from the first reduced diameter to a second reduced diameter.

12. The apparatus of claim 11, wherein each of the plurality of impact tools comprise:

a rotor; and a plurality of tungsten carbide tool heads, each respective tungsten carbide tool head being removably coupled to the rotor.

13. The apparatus of claim 11, wherein the first mill portion comprises a first hinged hatch adapted to provide access to an interior of the first mill portion; and wherein the second mill portion comprises a second hinged hatch adapted to provide access to an interior of the second mill portion.

14. The apparatus of claim 11, wherein the plurality of grinding media comprises ceramic grinding media.

* * * * *